United States Patent [19]

Nilsson et al.

[11] Patent Number: 4,872,506

[45] Date of Patent: Oct. 10, 1989

[54] GASKET FOR PLATE HEAT EXCHANGER

[75] Inventors: Mats Nilsson; Bernt Tagesson; Ladislav Novak, all of Lund, Sweden

[73] Assignee: Alfa-Laval Thermal AB, Tumba, Sweden

[21] Appl. No.: 170,999

[22] PCT Filed: Oct. 30, 1986

[86] PCT No.: PCT/SE86/00497

§ 371 Date: Mar. 21, 1988

§ 102(e) Date: Mar. 21, 1988

[87] PCT Pub. No.: WO87/03673

PCT Pub. Date: Jun. 18, 1987

[30] Foreign Application Priority Data

Dec. 11, 1985 [SE] Sweden ..... 8505849

[51] Int. Cl.[4] ..... F28F 3/00; F16J 15/00

[52] U.S. Cl. ..... 165/166; 277/235 A; 277/235 R; 277/234; 277/227; 165/167

[58] Field of Search ..... 165/166, 167; 277/233, 277/234, 227, 235 A, 235 R, 209, DIG. 6

[56] References Cited

U.S. PATENT DOCUMENTS

| | | | |
|---|---|---|---|
| 2,193,405 | 3/1940 | Goodman | 165/167 |
| 3,909,019 | 9/1975 | Leko | 277/209 |
| 4,432,415 | 2/1984 | Wright | 165/166 |
| 4,477,087 | 10/1984 | Sutter, Jr. et al. | 277/235 |
| 4,519,619 | 5/1985 | Doyle | 277/DIG. 6 |

FOREIGN PATENT DOCUMENTS

| | | |
|---|---|---|
| 24195 | 2/1981 | European Pat. Off. . |
| 231629 | 1/1986 | Fed. Rep. of Germany . |
| 436928 | 1/1985 | Sweden . |
| 2069680 | 8/1981 | United Kingdom . |
| 2117890 | 10/1983 | United Kingdom . |

*Primary Examiner*—Henry A. Bennet
*Assistant Examiner*—Denise L. Ferensic
*Attorney, Agent, or Firm*—Davis Hoxie Faithfull & Hapgood

[57] ABSTRACT

A gasket for a plate heat exchanger has a strip of metal fastened to one heat exchanger plate and bridging at least 50% but not the entire distance between that plate and an adjacent plate, and a layer of a material of lesser hardness than the metal attached to the metal strip and bridging the remaining distance between the plates.

9 Claims, 2 Drawing Sheets

GASKET FOR PLATE HEAT EXCHANGER

Figure 1:
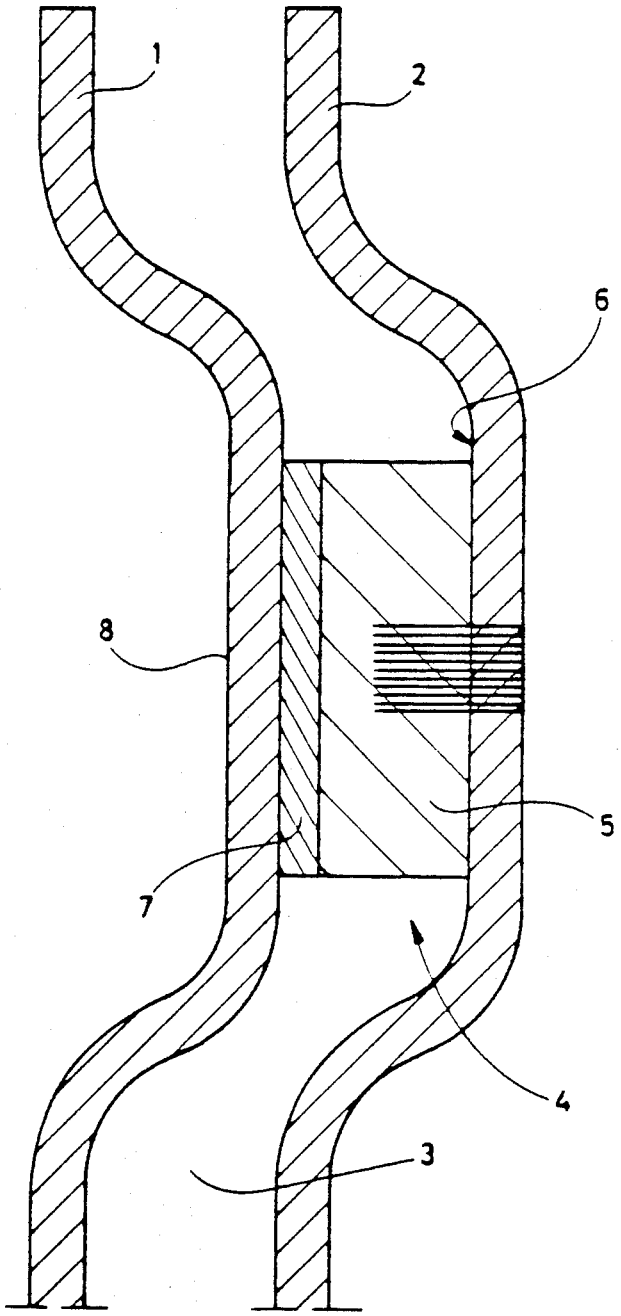

This invention relates to a gasket for a plate heat exchanger, intended to be applied between two adjacent plates in the heat exchanger, the space between the plates forming a passage for a heat exchange medium.

A plate heat exchanger comprises several essentially rectangular plates, as a rule mounted in a frame, which plates are sealed off from each other by means of edge gaskets and between which heat transfer areas are created in the form of parallel-connected heat exchange passages for through-flow of heat exchange media which are conducted to and from the heat exchanger via inlets and outlets arranged at one of its ends, the plates at their corner portions being provided with openings for forming inlet channels and outlet channels for the heat exchange media.

Such plate heat exchangers are manufactured in different sizes with plates, the heat transfer areas of which can vary from some few square decimeters to several square meters. The plate material is selected with regard to the field of application but is usually composed of stainless or acid resisting steel. For certain purposes titanium is used which has an excellent resistance against salt water but is very expensive.

The edge gaskets sealing between the plates are essentially composed of rubber of varying qualities. The sealing pressure of the rubber gaskets is received when the plate package is clamped together by the frame by means of set bolts and is maintained by the elasticity of the rubber.

A plate heat exchanger can easily be taken to pieces and be inspected or cleaned and thereafter be tightened together again as long as the gaskets maintain their elasticity and their form.

At moderate temperatures, below 70°–80° C., the gaskets have such a long life as 10–15 years. However, at higher temperatures the gaskets are settled and lose their original form and due to that fact their sealing ability. Under such circumstances the gaskets have to be exchanged once per year or still more often which is an expensive procedure.

This invention intends to remove the problems connected with the known technique. This has been made possible by a gasket of the kind mentioned by way of introduction which is characterized in that it comprises a metal strip, one surface of which is fastened to one of the plates, the metal strip taking up at least 50% of but not the whole space between the plates in the area of the metal strip, and a layer applied onto the surface of the metal strip which surface is opposite to the fastened surface of the metal strip, which layer fills out the remaining part of the mentioned space between the plates and is made of a material with a lower hardness than metal. By this arrangement the great advantage is achieved that the gasket becomes very flexible and may be used in different types of plate heat exchangers where the distances between the plates being integral parts of the heat exchanger vary largely. If accordingly the gasket shall be used in a plate heat exchanger with a greater distance than normal between the plates, the thickness of the metal strip shall be made larger and vice versa. The layer of a lower hardness of metal being applied onto the metal strip can accordingly be of a relatively constant thickness.

The invention shall hereinafter be described more closely in connection with the accompanying drawings which as examples disclose two embodiments of the invention.

In FIG. 1 there are shown two heat exchange plates 1, 2 between which there is formed a passage 3 for a heat exchange medium. In order to prevent that this medium comes out into the atmosphere outside the plates, a gasket 4 is arranged between the plates. This gasket 4 comprises a metal strip 5 which is applied into the gasket groove 6 of one of the plates. In this connection the metal strip extends in the gasket groove of the plate along the whole extension of the gasket groove. The metal strip is fastened to the plate along its whole extension, preferably by means of welding as has been indicated in the drawing. Other fastening methods can be soldering and glueing.

The thickness of the metal strip 5 is such that it takes up at least 50% of but not the whole space between the plates in the area of the metal strip. In this connection the metal strip preferably takes up 75–95% of the space between the plates. The remaining part of the mentioned space between the plates is filled up by a layer 7 which is made of a material with a lower hardness than metal and which is accordingly applied onto the surface of the metal strip being opposite to the surface of the metal strip which surface is fastened to the plate. The layer is accordingly applied between the outer limiting surface of the metal strip 5 and the adjacent plate. Due to the fact that the layer 7 has a lower hardness than metal it does not need to be fastened to the plate resting against the layer, but perfect sealing is achieved by the fact that the plate is pressed against the layer. This gives that advantage that the spaces between the plates become easily accessible for cleaning, for instance.

In this case the layer 7 will accordingly rest against the outside of the gasket groove 8 of the other plate 1, whereby there is a sealing arrangement between the two plates.

Figure 2:
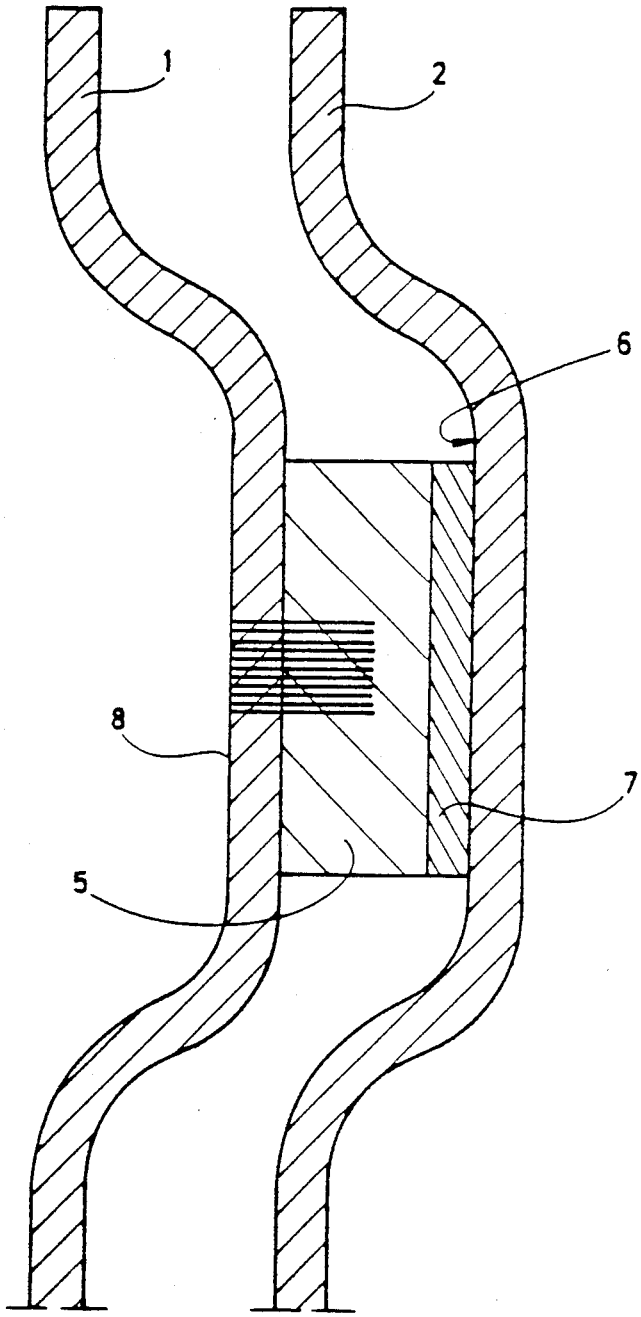

The embodiment according to FIG. 2 differs from that according to FIG. 1 only in that respect that the metal strip 5 is fastened to the outside of the gasket groove 8 of the plate 1, while the layer 7 rests against the plate 2 in the bottom of its gasket groove 6.

The metal plate is preferably made of stainless steel while the layer on the metal strip preferably comprises graphite. Alternatively, the layer can be composed of a plastics material.

Graphite is an expensive material and therefore it is of great value, when different thickness of the gasket is required, that it is the cheap part, i.e. the metal strip, that is adapted to the changed conditions, while the thickness of the expensive part, i.e. the graphite layer, is kept essentially constant.

The metal strip, of course, can be made of different materials. Thus, the strip can be made of one material in the passages for one of the media, while the strip can be made of another material in the passages for the other medium. Furthermore, one and the same strip may comprise two or more layers of the same or different materials.

If the layer on the metal strip has a low elasticity, the set bolts can be supplemented with cup springs so that the sealing pressure is maintained.

We claim:

1. In combination with a plate heat exchanger having a plurality of heat exchange plates, there being spaces between adjacent plates in the heat exchanger defining flow passages for heat exchange media, a gasket applied between two adjacent plates characterized in that the gasket (4) comprises a strip (5) of metal, fastened to one of the plates (1, 2) and bridging at least 50% of but not the whole distance between the plates, and a layer (7) made of a material with a lesser hardness than the metal and applied onto a surface of the metal strip directed towards the other of said two plates (1, 2), said layer (7) bridging the remaining part of said distance between the plates.

2. The combination of claim 1, wherein each plate has a gasket groove (6, 8) on one side of said plate, said groove forming a ridge on the opposite side of said plate, characterized in that the metal strip (5) is fastened to said one of said plates (1, 2) at the bottom of its gasket groove (6, 8).

3. The combination of claim 1, wherein each plate has a gasket groove (6, 8) on its side, forming a ridge on its opposite side, characterized in that the metal strip (5) is fastened to said one of the plates (1, 2) at the top of its ridge.

4. The combination of claim 2, characterized in that the metal strip (5) extends along the whole of the gasket groove (6, 8).

5. The combination of claim 1, characterized in that the metal strip (5) is made of stainless steel.

6. The combination of claim 1, characterized in that the metal strip (5) is fastened to said one of the plates along its whole extension by means of welding.

7. The combination of claim 1, characterized in that said layer (7) is composed of a graphite material.

8. The combination of claim 1, characterized in that said layer (7) is composed of a plastics material.

9. The combination of claim 3, characterized in that the metal strip (5) extends along the whole of the gasket groove (6, 8).

* * * * *